US010294687B2

(12) United States Patent
Brockman et al.

(10) Patent No.: US 10,294,687 B2
(45) Date of Patent: May 21, 2019

(54) SYSTEM FOR COUPLING TOGETHER SEGMENTS OF A UTILITY POLE, AND A UTILITY POLE ASSEMBLY COMPRISING THE SAME

(71) Applicant: Valmont West Coast Engineering Ltd., Delta (CA)

(72) Inventors: Ted Brockman, Delta (CA); Zoltan Banyi, Delta (CA); Ioan Giosan, Delta (CA)

(73) Assignee: Valmont West Coast Engineering Ltd., Delta (CA)

( * ) Notice: Subject to any disclaimer, the term of this patent is extended or adjusted under 35 U.S.C. 154(b) by 0 days.

(21) Appl. No.: 15/346,673

(22) Filed: Nov. 8, 2016

(65) Prior Publication Data

US 2018/0128003 A1 May 10, 2018

(51) Int. Cl.

| | |
|---|---|
| ***E04C 3/00*** | (2006.01) |
| ***E04H 12/08*** | (2006.01) |
| ***E04H 12/34*** | (2006.01) |

(52) U.S. Cl.

CPC ..... *E04H 12/085* (2013.01); *E04H 12/342* (2013.01)

(58) Field of Classification Search

CPC ..... E04H 12/085; E04H 12/342

USPC ..... 52/849, 146, 153, 848, 855

See application file for complete search history.

(56) References Cited

U.S. PATENT DOCUMENTS

| | | | | |
|---|---|---|---|---|
| 122,656 A | | 1/1872 | Rogers | |
| 449,977 A | * | 4/1891 | Stern | H01Q 1/1242 52/849 |
| 595,600 A | | 12/1897 | Buck | |
| 811,435 A | * | 1/1906 | Perdue | E04H 12/10 52/651.01 |
| 998,839 A | * | 7/1911 | Carleton | H01Q 1/1242 256/51 |
| 1,067,804 A | * | 7/1913 | Davis | E04H 7/28 52/192 |
| 1,079,681 A | | 11/1913 | Wintroath | |

(Continued)

FOREIGN PATENT DOCUMENTS

| | | |
|---|---|---|
| AT | 26961 | 1/1907 |
| CA | 693708 | 9/1964 |

(Continued)

OTHER PUBLICATIONS

Two photos of a crane installing a utility pole assembly having a standard slip fit arrangement, with the photos being taken on Nov. 7, 2015.

*Primary Examiner* — Basil S Katcheves

(74) *Attorney, Agent, or Firm* — Cameron IP

(57) ABSTRACT

There is provided a utility pole assembly including a utility pole. The utility pole includes a plurality of pole segments. A first said pole segment includes a flange and an end portion extending outwards from the flange. A second said pole segment is shaped to fit about the end portion. The second said pole segment having a distal end and including a flange adjacent to said distal end of the second said pole segment. The assembly includes at least one longitudinally-extending guide pin connectable with a first one of the flanges. The guide pin is at least partially extendable through a second one of the flanges.

20 Claims, 6 Drawing Sheets

(56) References Cited

U.S. PATENT DOCUMENTS 1,743,439 A * 1/1930 De Witt ..... E04H 12/08 24/486
3,031,041 A 4/1962 Pfaff
3,034,209 A 5/1962 Bianca et al.
3,036,407 A * 5/1962 Dixon ..... E04B 2/10 52/439
3,270,480 A 9/1966 Beecker
3,544,110 A * 12/1970 Dickinson ..... A63B 71/023 473/483
3,713,262 A * 1/1973 Jatcko ..... E01F 9/635 248/158
3,865,498 A 2/1975 Okuto et al.
3,911,548 A 10/1975 Perry
3,988,870 A * 11/1976 Snavely ..... E02D 27/42 174/38
4,033,080 A 7/1977 Fukushima
4,048,779 A 9/1977 Valenziano et al.
4,272,929 A 6/1981 Hanson
4,454,699 A * 6/1984 Strobl ..... F16B 13/02 403/298
4,543,764 A 10/1985 Kozikowski
4,617,768 A 10/1986 Gebelius
4,779,389 A 10/1988 Landers
4,785,593 A * 11/1988 Munoz, Jr. ..... E02D 27/42 52/126.1
4,894,043 A * 1/1990 Nixon, Jr. ..... B25B 23/1415 403/2
4,926,592 A * 5/1990 Nehls ..... E01F 9/635 256/13.1
4,986,687 A * 1/1991 Ivey ..... H02G 1/02 256/13.1
5,333,436 A * 8/1994 Noble ..... E04H 12/085 403/337
5,398,478 A 3/1995 Gordin et al.
5,524,408 A 6/1996 Richey
5,600,537 A 2/1997 Gordin et al.
5,687,537 A * 11/1997 Noble ..... H01Q 1/1242 403/337
5,749,189 A * 5/1998 Oberg ..... E01F 9/638 248/548
5,880,404 A 3/1999 Stanley et al.
5,881,515 A * 3/1999 George ..... A63H 33/044 403/294
6,191,355 B1 * 2/2001 Edelstein ..... E04H 12/08 174/45 R
6,340,790 B1 1/2002 Gordin et al.
6,398,392 B2 6/2002 Gordin et al.
6,399,881 B2 6/2002 Edelstein
6,540,196 B1 * 4/2003 Ellsworth ..... E01F 9/635 248/548
6,568,712 B1 * 5/2003 Aaron, III ..... B23K 37/0533 285/24
6,868,641 B2 * 3/2005 Conner ..... E01F 9/635 52/165
7,171,793 B2 2/2007 Gordin et al.
7,523,912 B1 * 4/2009 Woods ..... E01F 9/696 116/63 R
7,866,927 B1 1/2011 Wong
8,191,332 B1 6/2012 Semaan et al.
8,201,332 B2 * 6/2012 Tourneur ..... E04C 3/34 29/458
8,302,368 B1 11/2012 Keel
8,801,331 B2 * 8/2014 Perner ..... E02D 27/42 405/204
9,284,710 B2 * 3/2016 Nyce ..... E04H 12/2261
2001/0013419 A1 8/2001 Edelstein
2001/0018978 A1 9/2001 Gordin et al.
2003/0089073 A1 5/2003 Enns
2004/0118077 A1 6/2004 Chin et al.
2004/0139665 A1 * 7/2004 Ullrich ..... E04H 12/16 52/169.9
2008/0250752 A1 10/2008 Bowman et al.
2008/0308696 A1 * 12/2008 Kristensen ..... E04H 12/085 248/230.1
2009/0019816 A1 1/2009 Lockwood et al.
2009/0021019 A1 * 1/2009 Thomsen ..... E04H 12/085 290/55
2009/0300996 A1 * 12/2009 Jones ..... E04C 3/30 52/40
2010/0307097 A1 * 12/2010 Word, III ..... E04H 12/085 52/651.07
2011/0047900 A1 3/2011 Holmes
2013/0008096 A1 1/2013 Griffiths et al.
2014/0237932 A1 * 8/2014 Moestrup ..... E04H 12/342 52/651.01
2015/0159635 A1 * 6/2015 Hayden ..... F03D 11/04 290/55
2015/0252565 A1 9/2015 Holmes

FOREIGN PATENT DOCUMENTS

| | | |
|---|---|---|
| DE | 2708664 | 9/1977 |
| EP | 0440531 | 8/1991 |
| FI | 35365 | 10/1965 |
| GB | 705891 | 3/1954 |
| WO | 2003000022 | 1/2003 |

* cited by examiner

SYSTEM FOR COUPLING TOGETHER SEGMENTS OF A UTILITY POLE, AND A UTILITY POLE ASSEMBLY COMPRISING THE SAME

BACKGROUND OF THE INVENTION

Field of the Invention

There is provided a coupling system. In particular, there is provided a coupling system for coupling together segments of a utility pole and a utility pole assembly comprising the same.

Description of the Related Art

U.S. Pat. No. 4,272,929 to Hanson discloses a tower for a wind generator. The tower comprises a plurality of segments where each segment fits into the one below it and is adjustable relative that lower segment. The lower segment is anchored in the ground and includes a stirrup which holds the lowest section of the tower a distance above the bottom of the hole so that when cement is poured into the hole to anchor the tower, the cement flows up into the interior of the tower to give additional support. Adjustment means in the form of set screws are provided where each pair of sections join to allow alignment of the sections to vertical.

U.S. Pat. No. 4,543,764 to Kozikowski discloses forming one or more sheets about standing poles to try to enhance the structural characteristics of the poles. The sheets are defined by an outer jacket, a plurality of spacer members positioned within the jacket and a solidified encapsulating material which fills the jacket.

One of the drawbacks of a slip fit type connection for utility poles is that the overlap is somewhat variable. Slip fit connections, by their nature, are variable length depending on many design and fabrication tolerance parameters. In an application where overall height is critical, such systems may not be used. Other problems include aligning the pole sections and taking the joint apart if this ever becomes necessary. Such systems also have a tendency to settle over time after installation. In some applications, this is unacceptable and slip joint connections thus cannot be used.

BRIEF SUMMARY OF INVENTION

There is accordingly provided, and it is an object to provide, an improved utility pole assembly, coupling system therefor, and method of installing the same.

According to one aspect, there is provided a utility pole assembly. The assembly includes a utility pole comprising a plurality of pole segments. A first said pole segment includes a flange and an end portion extending outwards from the flange. A second said pole segment is shaped to fit about the end portion. The second said pole segment has a distal end and including a flange adjacent to said distal end of the second said pole segment. The assembly includes at least one longitudinally-extending guide pin connectable with a first one of the flanges. The guide pin is at least partially extendable through a second one of the flanges.

According to another aspect, there is provided a utility pole assembly. The utility pole assembly includes a utility pole comprising a plurality of pole segments. A first said pole segment includes a flange and an end portion extending outwards from the flange. A second said pole segment includes a flange adjacent to a distal end thereof. The second said pole segment is shaped to fit about the end portion via a slip fit connection. The assembly includes a plurality of elongate extraction members threadably engageable with a first one of the flanges. The extraction members are abuttable against a second one of the flanges. Actuation of the extraction members causes the pole segments to disengage from the slip fit connection.

According to a further aspect, there is provided a coupling system for coupling a first utility pole segment to a second utility pole segment. Each of the pole segments has a distal end. The system includes a first flange connectable to the first utility pole segment at a location spaced-apart from the distal end of the first utility pole segment. The first flange defines an end portion of the first utility pole segment extending between the flange and the distal end of the first utility pole segment. The system includes a second flange connectable to the second utility pole segment adjacent to the distal end of the second utility pole segment. Each of the flanges has at least one fastener aperture extending therethrough. The second utility pole segment is shaped to fit about the end portion of the first utility pole segment. The system includes at least one guide pin connectable with a first one of the flanges. The guide pin is extendable into a second one of the flanges upon the second utility pole segment extending about the end portion of the first utility pole segment. The fastener apertures are positioned to align with each other upon the guide pin connecting to the first one of the flanges and extending into the second one of the flanges.

According to yet another aspect, there is provided a method of connecting a first utility pole segment to a second utility pole segment. The method includes coupling a first flange to the first utility pole segment adjacent to an end portion of the first utility pole segment. The method includes coupling a second flange to the second utility pole segment adjacent to a distal end of the second utility pole segment. The method includes positioning the second utility pole segment about the end portion of the first utility pole segment. The method includes aligning the second utility pole segment relative to the first utility pole segment via at least one elongate alignment member. This aligning step includes coupling the guide pin to a first of the utility pole segments and extending through a second of the utility pole segments. The method includes coupling the flanges of the utility pole segments so aligned together via one or more fasteners.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
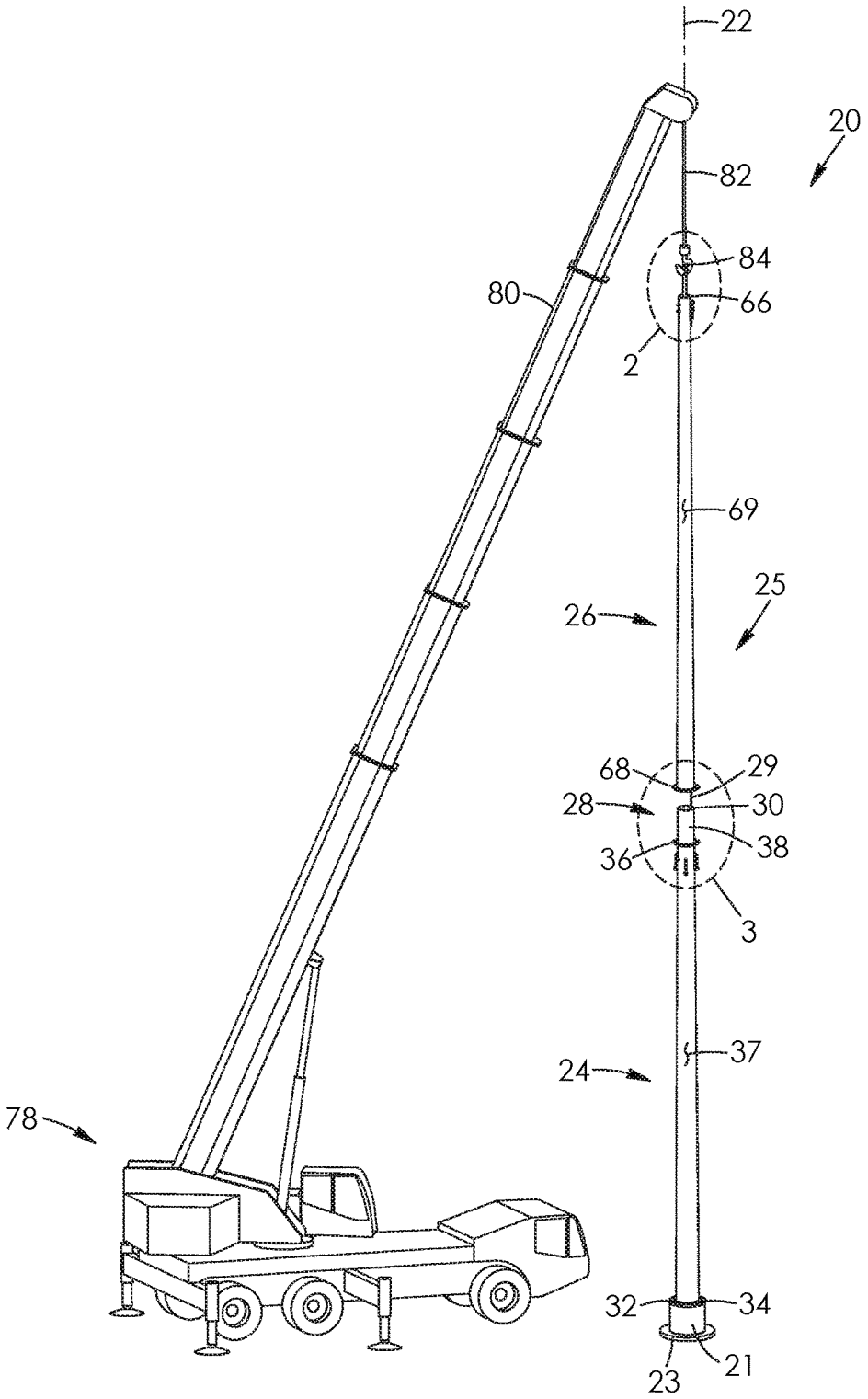
FIG. 1 is a front, top perspective view of a crane and a utility pole assembly according to a first aspect, the assembly comprising a utility pole including a lower pole segment and an upper pole segment in the process of being lowered onto the lower pole segment.

Referring to the drawings and first to FIG. 1, there is shown a utility pole assembly 20. The assembly has a longitudinal axis 22. The assembly 20 includes a utility pole 25 comprising a plurality of pole segments, in this example a first or lower pole segment 24 and a second or upper pole segment 26. However, this number is not strictly required and the utility pole may have more than two segments in other embodiments, such as six or more segments in other examples. The assembly 20 includes a conduit in this example an electrical cable 29 extending through the utility pole segments.

As seen in FIG. 1, the lower pole segment has an upper or distal end 30, a lower or proximal end 32 spaced-apart from the distal end, and an annular side 37 extending between the ends thereof. The lower pole segment 24 includes a lower flange 34 adjacent to the proximal end thereof. The lower flange extends radially outwards and is shaped to couple to a base 21 of the utility pole assembly 20. The base 21 rests upon foundation 23. The lower pole segment 24 has two pairs of transversely extending apertures between the distal end 30 and the proximal end 32 thereof. This is shown in FIG. 3 by aperture 33 for the first pair of apertures and aperture 35 for the second pair of apertures which extend through the side 37 of the lower pole segment 24.

Figure 3:
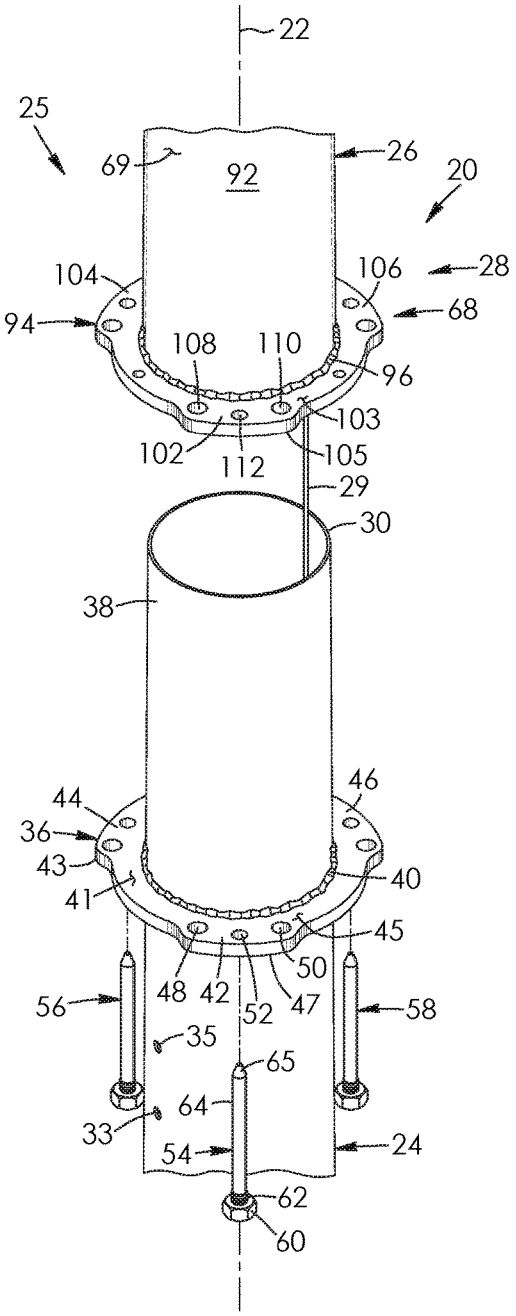
FIG. 3 is an enlarged, front, top perspective view of FIG. 1 showing a lower portion of the upper pole segment adjacent to an upper end portion of the lower pole segment, the pole segments being shown in fragment and a plurality of guide pins shown in an exploded view.

As seen in FIG. 3, the lower pole segment 24 includes an upper annular flange 36 and an end portion 38 extending outwards, in this example upwards from said flange. The end portion of the lower pole segment is tubular and extends from the distal end 30 of the lower pole segment to the upper flange. The end portion 38 slightly tapers radially inwards as the end portion extends from flange 36 to distal end 30 of the lower pole segment in this example. Flange 36 extends radially outwards and is coupled to the lower pole segment, in this example via weld 40.

Figure 4:
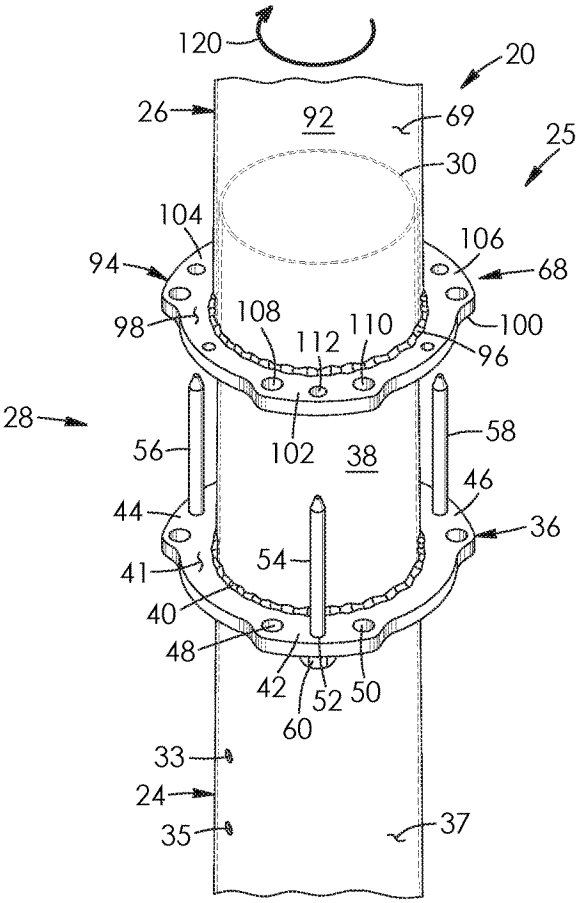
FIG. 4 is a front, top perspective view of the lower portion of the upper pole segment of FIG. 3 in the process of being fitted about the upper end portion of the lower pole segment of FIG. 3, the pole segments being shown in fragment and the guide pins being shown threadably coupled to a flange of the lower pole segment.

As seen in FIG. 3, transversally-extending apertures 33 and 35 are adjacent to the upper flange 36 in this example. As seen in FIG. 4, the flange has a generally annular top 41 and, as seen in FIG. 3, a generally annular bottom 43.

As seen in FIG. 4, the upper flange includes a plurality of circumferentially spaced-apart, radially outwardly extending protrusions, in this example three protrusions 42, 44 and 46. Each of the protrusions has a substantially planar top and bottom and is generally rectangular in shape in this example. This is shown in FIG. 3 by protrusion 42 have a top 45 and bottom 47. The flange 36 has a plurality of circumferentially spaced-apart fastener apertures extending therethrough, in this example in the form of a pair of spaced-apart fastener apertures per protrusion. This is shown by fastener apertures 48 and 50 extending through protrusion 42 of the flange.

The upper flange 36 further includes a plurality of circumferentially spaced-apart additional apertures extending therethrough in this embodiment, in this example in the form of one threaded, guide pin aperture per protrusion. This is shown by in FIG. 3 by guide pin aperture 52 extending through protrusion 42 of the flange. Having the guide pins threaded into the flange 36 after the latter has been galvanized and prior to the transportation of the various parts of the assembly 20 may inhibit damage of the guide pins. This may also reduce operator installation time and facilitate subsequent assembly of the utility pole 25. Each of the guide pin apertures 52 is between paired ones 48 and 50 of the fastener apertures of the protrusions of the flange of the lower pole segment in this example.

As seen in FIG. 3, the utility pole assembly 20 includes at least one, and this example a plurality of circumferentially spaced-apart, longitudinally-extending alignment members, such as keys or in this example guide pins. In this case the assembly includes three guide pins 54, 56 and 58. However, this number is not strictly required and there may be only one guide pin, a pair of guide pins, or more than three guide pins in other examples. The guide pins 54, 56 and 58 extend longitudinally parallel with the longitudinal axis 22 of the assembly 20. Each guide pin has a head in this example in the form a nut 60, a threaded portion 62 adjacent to the nut, and an elongate, shaft 64 coupled to and extending outwards from the threaded portion in this example. The nut is welded to the rest of the guide pin in this example. Each guide pin has a tapered end 65 spaced-apart from the nut 60 thereof. The guide pins 54, 56 and 58 are connectable to flange 36 of the lower pole segment in this example by inserting the pins from below the flange such that the nuts 60 thereof abut the bottom 43 of the flange, as seen in FIG. 4.

Referring back to FIG. 3, the threaded portions 62 of the guide pins 54 are shaped to threadably engage with respective ones of the guide pin apertures 52. Engagement of the nut 60 with a wrench enables the guide pin to be threadably secured to the flange. As seen in FIG. 4, each of the guide pins is thus positioned between paired ones 48 and 50 of the fastener apertures of the flange 36 of the lower pole segment 24 in this example. The guide pins are thus connectable to and extend axially outwards from respective ones of the protrusions of the flange of the lower pole segment.

Figure 2:
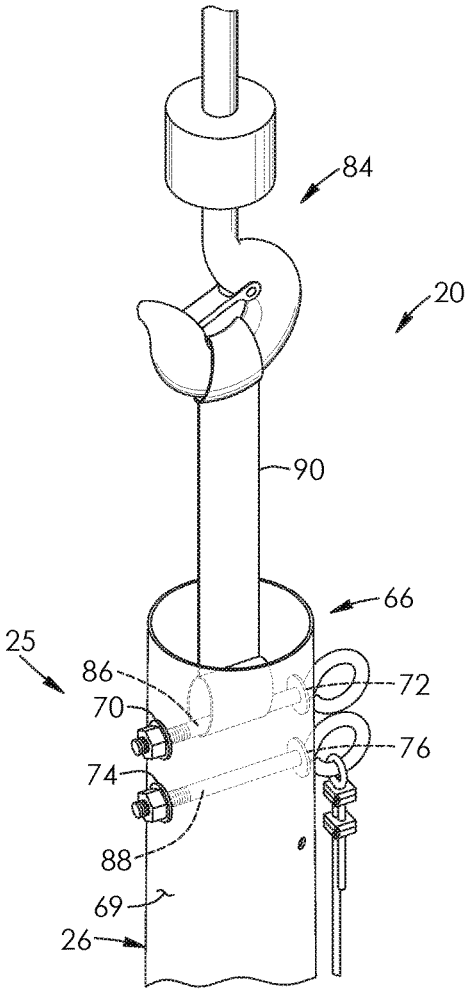
FIG. 2 is an enlarged, front, top perspective view of FIG. 1 showing the crane in fragment coupled to an upper portion of the upper pole segment of FIG. 1, the upper pole segment also being shown in fragment.

Referring to FIG. 1, the upper pole segment 26 has a first or upper end 66, a second, lower, or distal end 68 spaced-apart from said upper end, and an annular side 69 extending between the ends thereof. The upper pole segment has two pairs of transversely extending apertures adjacent to the upper end 66 thereof. This is shown in FIG. 2 by a first pair of apertures 70 and 72 and a second pair of apertures 74 and 76.

Referring to FIG. 1, the upper pole segment 26 may be raised and positioned in place relative to the lower pole segment 24 via a lifting machine, in this example a crane 78. The crane includes a telescopic arm 80, a cable 82 extending from the arm and a crane hook 84 coupled to the cable. Cranes per se, including their various parts and functionings, are known to those skilled in the art and thus crane 78 will not be described in detail.

The upper pole segment 26 couples to the hook in this example via a pair of elongate members 86 and 88 which threadably couple to the pole segment via the first pair of apertures 70 and 72 and second pair of apertures 74 and 76, and a strap 90 which extends between and couples together the elongate members and the hook. The elongate members and strap are shown partially in ghost in FIG. 2. In a like manner, the lower pole segment 24 seen in FIG. 3 may be selectively raised and moved in place by the crane by extending elongate members through apertures 33 and 35 of the lower pole segment.

Still referring to FIG. 3, at least the distal end portion 92 of the upper pole segment 26 is shaped to fit about the end portion 38 of the lower pole segment via a slip fit connection. The end portion of the lower pole segment 24 is shown partially in ghost in FIG. 4.

As seen in FIG. 4, the upper pole segment includes a flange 94 adjacent to said distal end 68 thereof. Flange 94 extends radially outwards and is coupled to the lower pole segment, in this example via weld 96. As seen in FIG. 4, the flange 94 has a generally annular top 98 and a generally annular bottom 100 spaced-apart from the top thereof.

As seen in FIG. 4, flange 94 includes a plurality of circumferentially spaced-apart, radially outwardly extending protrusions, in this example three protrusions 102, 104, and 106. Each of the protrusions has a substantially planar top and bottom and is generally rectangular in shape in this example. This is shown in FIG. 3 by protrusion 102 having a top 103 and bottom 105. The flange 94 has a plurality of circumferentially spaced-apart fastener apertures extending therethrough, in this example in the form of a pair of spaced-apart fastener apertures per protrusion. This is shown by fastener apertures 108 and 110 extending through protrusion 102 of the flange.

The flange 94 further includes a plurality of circumferentially spaced-apart additional apertures extending therethrough in this embodiment, in this example in the form of one alignment aperture per protrusion. This is shown in FIG. 4 by alignment aperture 112 extending through protrusion 102 of the flange. Each of the alignment apertures 112 is between paired ones 108 and 110 of the fastener apertures of the protrusions of the flange 94 of the upper pole segment 26 in this example.

Figure 6:
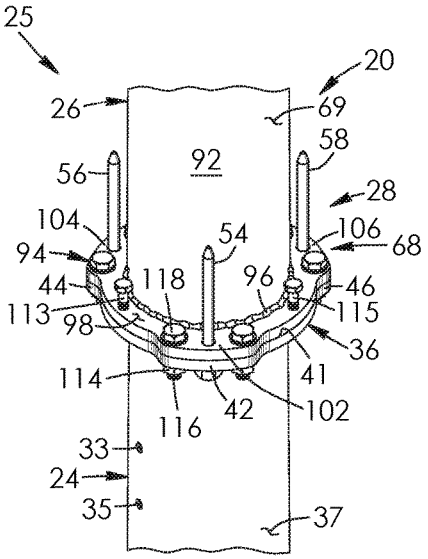
FIG. 6 is a front, top perspective view of the lower portion of the upper pole segment and the upper end portion of the lower pole segment of FIG. 5, with the pole segments being shown in fragment and with the flanges of the utility pole segments being shown coupled together via a plurality of nuts and bolts.

As seen in FIG. 6, the utility pole assembly 20 further includes a plurality of elongate extraction members, in this example extraction bolts threadably coupled to the upper flange 94. In this example there are three extraction bolts, as shown by bolts 113 and 115 in FIG. 6. Each bolt is positioned between a pair of said protrusions in this example. This shown by bolt 113 positioned between protrusions 102 and 104.

Figure 5:
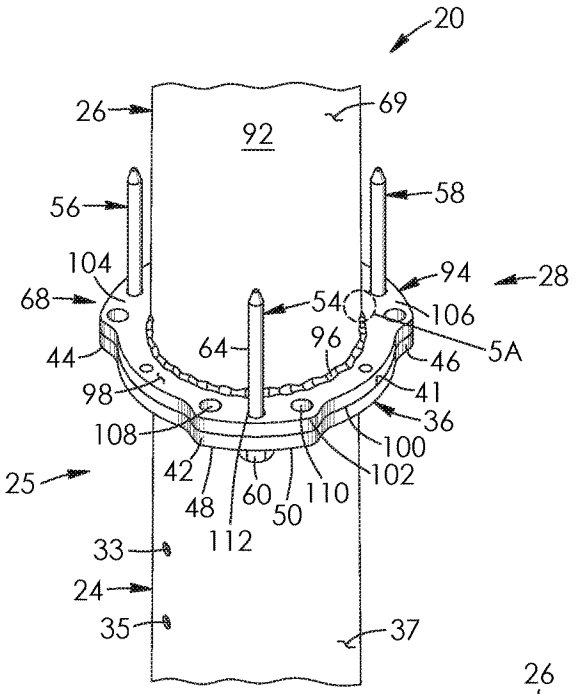
FIG. 5 is a front, top perspective view of a flange adjacent to the lower portion of the upper pole segment of FIG. 4 abutting the flange of the lower pole segment of FIG. 4, the pole segments being shown in fragment and the guide pins being shown extending through alignment apertures of the flange of the upper pole segment.

Referring to FIG. 5, the guide pins 54, 56 and 58 are shaped to be extendable through respective ones of the alignment apertures 112 of the flange of the upper pole segment. The fastener apertures 108 and 110 of flange 94 are positioned to align with respective ones of the fastener apertures 48 and 50 of flange 36 of the lower pole segment 24 upon the guide pins extending through the flange of the upper pole segment. As seen in FIG. 5, the protrusions 42, 44 and 46 of the flange of the lower pole segment align within the protrusions 102, 104 and 106 of the flange of the upper pole segment upon the guide pins 54, 56 and 58 extending through the flange of the upper pole segment. As seen in FIG. 4, the upper pole segment 26 so aligned is thus shaped to extend about and slip fit with the end portion 38 of the lower pole segment 24 with, as seen in FIG. 5, bottom 100 of flange 94 abutting the top 41 of flange 36.

Figure 7:
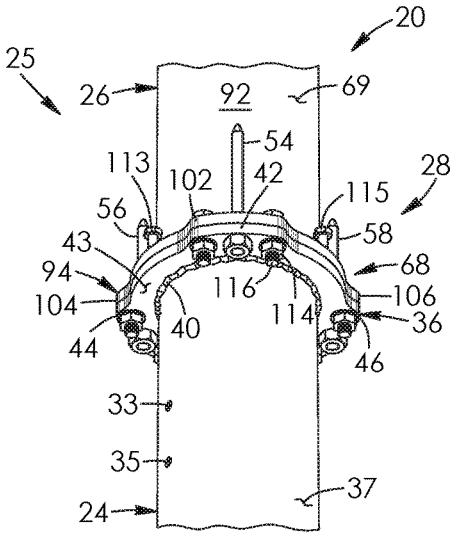
FIG. 7 is a front, bottom perspective view of the lower portion of the upper pole segment and the upper end portion of the lower pole segment of FIG. 5, with the pole segments being shown in fragment and with the flanges of the utility pole segments being shown coupled together via a plurality of nuts and bolts.

As seen in FIG. 6, the utility pole assembly 20 includes a plurality of fasteners shaped to extend through the fastener apertures of the flanges 94 and 36 so aligned, to selectively couple together the flanges. The fasteners in this example are in the form of a plurality of nuts and bolts shaped to threadably engage with respective ones of the nuts. This is shown in FIG. 7 by nut 114 abutting bottom 43 of flange 36 and threadably engaging with bolt 116. As seen in FIG. 6, each bolt has a bolt head 118 which abuts the top 98 of flange 94 in this example.

Referring to FIG. 1, there is thus herein provided a method of connecting a first, in this example upper pole segment 26 to a second, in this example lower pole segment 24.

As seen in FIG. 4, the method includes providing flange 36 with a plurality of circumferentially spaced-apart, axially-extending guide pins 54, 56 and 58. The method includes coupling the guide pins to the flange, in this example via threaded engagement of the pins with the flange.

The method includes providing flange 94 with a plurality of circumferentially spaced-apart alignment apertures 112 which align with respective ones of the guide pins of flange 94.

Referring to FIG. 3, the method further includes providing flange 36 with a plurality of circumferentially spaced-apart apertures 48 and 50. The method includes providing flange 94 with a plurality of circumferentially spaced-apart apertures 108 and 110 which align with the apertures of the first of the flanges upon the guide pins 54, 56 and 58 being inserted through flange 94.

The method includes coupling flange 36 to the lower pole segment adjacent to the end portion 38 thereof via weld 40 in this example. The method further includes coupling flange 94 to the upper pole segment 26 adjacent to distal end 68 thereof.

As seen with reference to FIGS. 1 and 4, the method includes positioning the upper pole segment about the end portion 38 of the lower pole segment 24 in this example via a crane 78. Referring to FIG. 4, the method includes selectively rotating via the crane the upper pole segment relative to the lower pole segment, as shown by arrow of numeral 120, so as to align the upper pole segment relative to the lower pole segment via guide pins 54, 56 and 58. The alignment step includes coupling the guide pins to flange 36 and thereafter extending the guide pins through the flange 94 via the alignment apertures 112 of flange 94.

Referring to FIGS. 6 and 7, the method includes coupling the flanges 36 and 94 of the utility pole segments 24 and 26 so aligned together via fasteners, in this example nuts 114 and bolts 116.

As seen in FIG. 4, the flanges 36 and 94 so shaped and guide pins 54, 56 and 58 may be said to comprise a coupling system 28 for coupling the upper pole segment 26 to the lower pole segment 24. The end portion 38 of the lower pole segment may also be said to be a part of this coupling system.

Figure 5A:
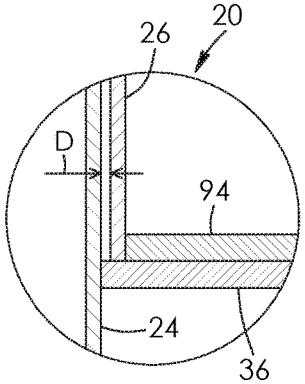
FIG. 5A is an enlarged, cross-sectional view of the assembly of FIG. 5 showing the lower portion of the upper pole segment at a location adjacent to the flange of the upper pole segment and the distal end portion of the lower pole segment at a location adjacent to the flange of the lower pole segment, with an annular gap therebetween.

A slip fit connection of the assembly may be most effective when it is tapered, because such a configuration promotes a tight, no-gap friction fit which may put a connection in a different, better fatigue category than a welded flange connection. The assembly 20 as herein described may be said to incorporate a fixed designed length connection. The assembly so configured is designed for a small clearance in the slip-fit that allows the flanges to always come in contact, while taking advantage of the slip fit feature also as it relates to assembly and servicing. Thus, as seen in FIG. 5A, the end portion 38 of lower pole segment 24 at a location adjacent to flange 36 has a small radially-inwardly extending clearance or gap D relative to the end portion 92 of upper pole segment 26 at a location adjacent to flange 94. This gap enables the flanges 36 and 94 to abut with each other. The guide pins are shaped to be long enough to lock the orientation of the upper utility pole segment 26 of the utility pole 25 before the taper of the slip-fit connection engages.

Figure 8:
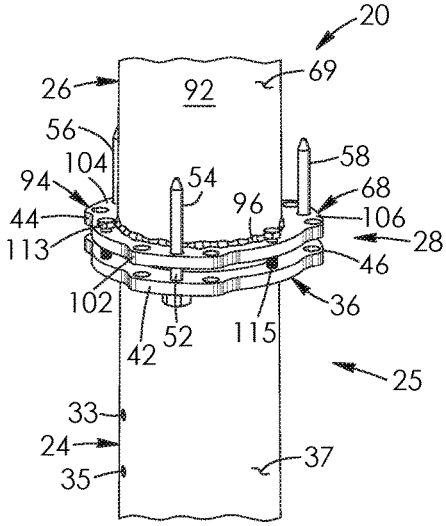
FIG. 8 is a front, top perspective view of the lower portion of the upper pole segment and the upper end portion of the lower pole segment of FIG. 5, with the pole segments being shown in fragment and with the flanges of the utility pole segments being shown adjacent to each other, the nuts being removed and slip fit extraction bolts of the flange of the upper pole segment being fully extended to space the flange of the upper pole segment from the flange of the lower pole segment.

Referring to FIG. 6, in order to disassemble the upper pole segment 26 from the lower pole segment 24, nuts 114 and bolts 116. Referring to FIG. 8, extraction bolts 113 and 115 may next be selectively actuated or extended, causing the bolts to abut and push against the top 41 of flange 36, and thereby resulting in flange 94 being spaced-apart from flange 36 as seen in FIG. 8. Thereafter and referring to FIG. 1, crane 78 may be use to remove upper pole segment 26 from lower pole segment 24 in a like manner as described above.

Alternatively, one or more guide pins themselves may be reversed and thereafter used to function as the extraction bolts.

Figure 10:
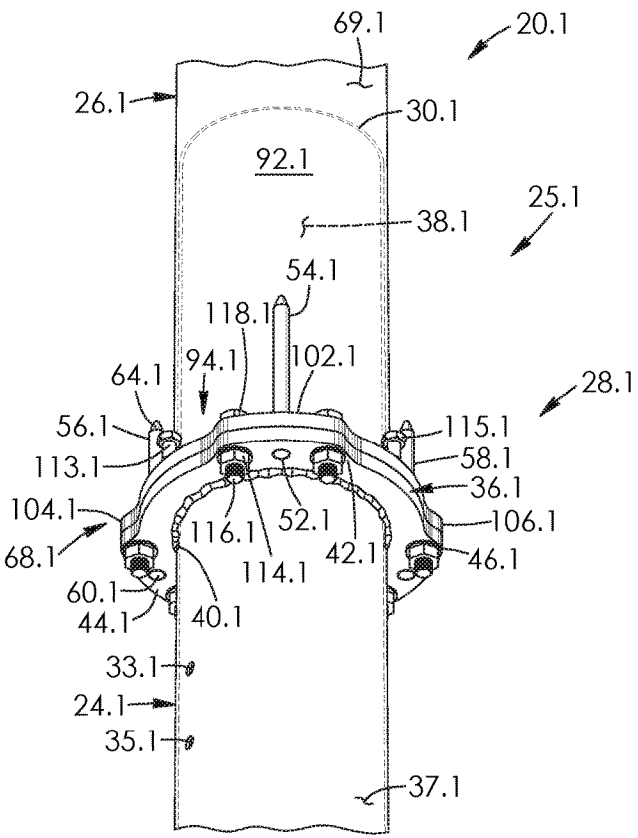
FIG. 10 is a front, bottom perspective view of the lower portion of the upper pole segment and the upper end portion of the lower pole segment of the assembly of FIG. 9, the utility pole segments being shown in fragment with the upper pole segment including a flange having a plurality of alignment apertures, the guide pins of FIG. 9 shown extending through said alignment apertures, and the flanges of the utility pole segments being shown coupled together via a plurality of nuts and bolts.
Figure 9:
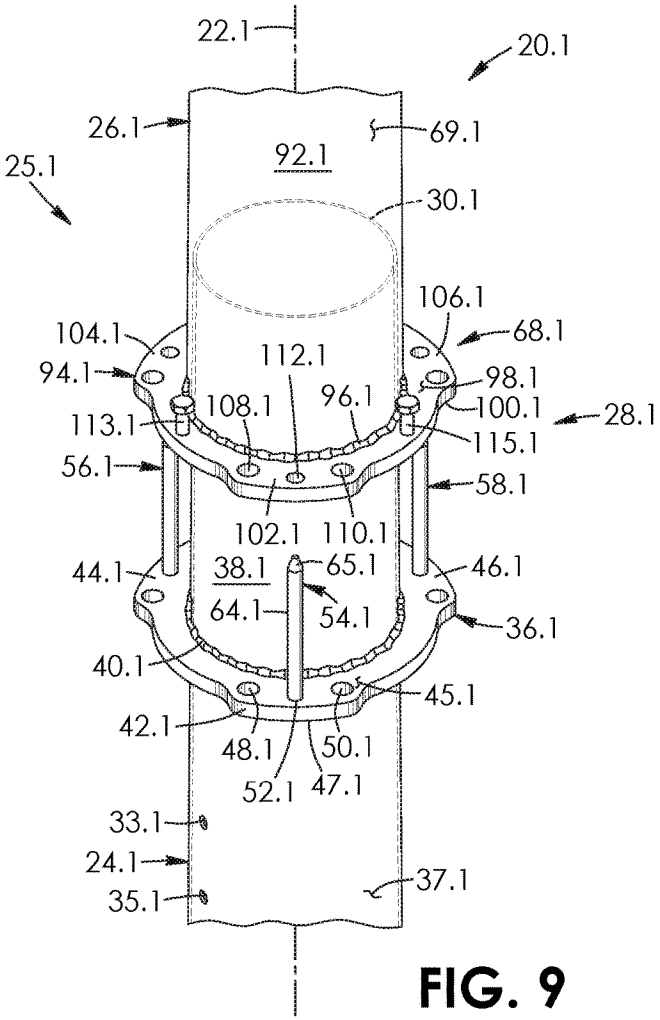
FIG. 9 is a front, top perspective of a utility pole assembly according to a second aspect, the assembly including an upper pole segment and a lower pole segment both shown in fragment, with the lower portion of the upper pole segment shown in the process of extending about the upper end portion of the lower pole segment, and the lower pole segment including a flange with a plurality of guide pins coupled thereto.

FIGS. 9 and 10 show a utility pole assembly 20.1 according to a second aspect. Like parts have like numbers and functions as the utility pole assembly 20 shown in FIGS. 1 to 8 with the addition of decimal extension "0.1". Utility pole assembly 20.1 is the same as described for utility pole assembly 20 shown in FIGS. 1 to 8 with at least the following exception.

In this embodiment, the guide pins 54.1, 56.1 and 58.1 are press-fit to the apertures 52.1 of the flange 36.1 of the lower pole segment 24.1. The end portion 38.1 of the lower pole segment 24.1 is shown partially in ghost in FIG. 9 and fully in ghost in FIG. 10.

Figure 11:
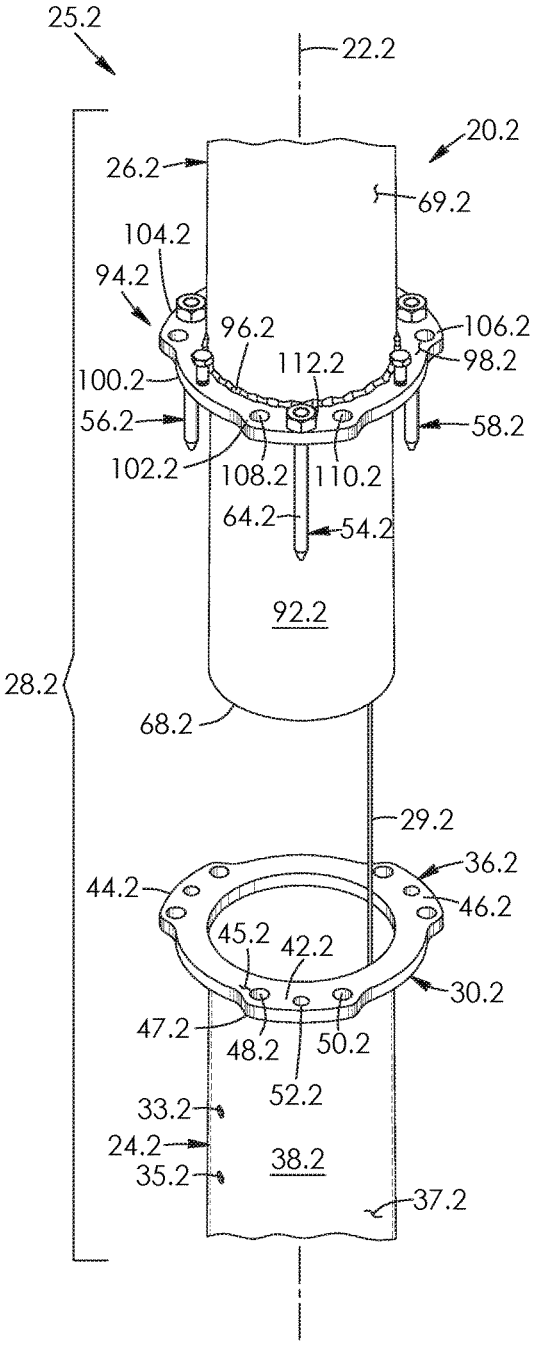
FIG. 11 is a front, top perspective view of a utility pole assembly according to a third aspect, the assembly comprising a lower pole segment and an upper pole segment in the process of being lowered in part into the lower pole segment.
Figure 12:
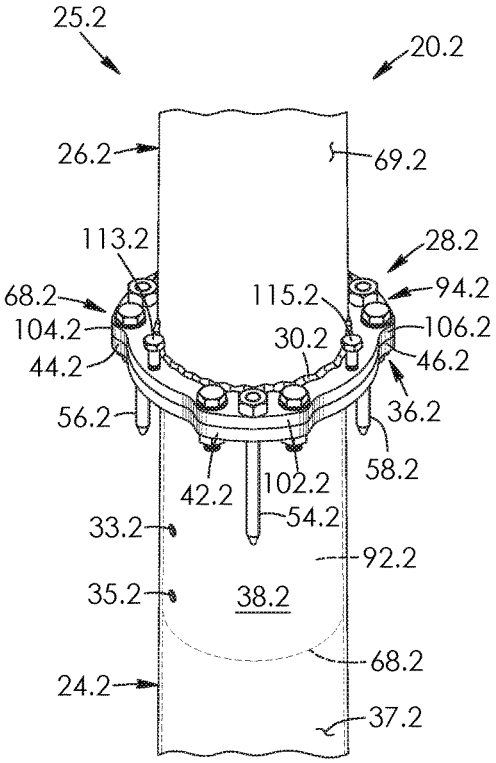
FIG. 12 is a front, top perspective view of the upper end portion of the lower pole segment of the assembly of FIG. 11 extending about the lower portion of the upper pole segment of the assembly of FIG. 11, the utility pole segments being shown in fragment with the upper pole segment including a flange with a plurality of guide pins coupled thereto, with the lower pole segment including a flange having a plurality of alignment apertures, the guide pins being shown extending through said alignment apertures, and with the flanges of the utility pole segments being shown coupled together via a plurality of nuts and bolts.

FIGS. 11 and 12 show a utility pole assembly 20.2 according to a third aspect. Like parts have like numbers and functions as the utility pole assembly 20 shown in FIGS. 1 to 8 with the addition of decimal extension "0.2". Utility pole assembly 20.2 is the same as described for utility pole assembly 20 shown in FIGS. 1 to 8 with at least the following exceptions.

In this embodiment, flange 94.2 is spaced-apart from the distal end 68.2 of the upper pole segment 26.2. The distal end portion 92.2 of the upper pole segment in this example extends downwards from the flange. The distal end portion of the upper pole segment 26.2 is tubular and extends from the distal end 68.2 of the upper pole segment to flange 94.2. The distal end portion 92.2 tapers slightly radially inwards as the distal end portion extends from flange 94.2 to distal end 68.2 of the upper pole segment.

As seen in FIG. 11, in this embodiment flange 36.2 is adjacent to the distal end 30.2 of the lower pole segment 24.2. At least the upper end portion 38.2 of the lower pole segment 24.2 is shaped to extend or fit about the end portion 92.2 of the upper pole segment 26.2 in a slip fit manner, as seen in FIG. 12. The end portion of the upper pole segment is shown in ghost in FIG. 12. The assembly 20.2 otherwise generally couples together in a like manner as described for assembly 20.

The assembly 20.2 in this embodiment may incorporate either a reversed tapered or straight fit connection. It is also possible to arrange the guide pins reversed as a variation but to keep the flange arrangement the same.

The utility pole assemblies 20, 20.1 and 20.2 as herein described provide many advantages. Each assembly incorporates ease of assembly with the strength of a slip fit connection with the precision of a flanged connection. The assemblies 20, 20.1 and 20.2 as herein described enable a slip joint type connection with a fixed overlap. By taking advantage of the strength of the slip fit connection, the flange size and number of bolts of the assemblies, as well as the welded connection may be greatly reduced, reducing the cost of the connection.

The guide pins 54, 56, 58, 54.1, 56.1 and 58.1 as herein described facilitate alignment of the utility pole segments 24, 26, 24.1, 26.1, 24.2 and 26.2. The guide pins ensure proper alignment of the fastener apertures of the flanges once the pins are engaged with the flange on the other of the pole segments. The length of guide pins enables this alignment of the utility pole segments prior to the slip-fit pole sections of the utility pole segments being engaged. The number of guide pins can vary and the guide pins may be permanent or removable. A portable drift pin or a pry bar may also be used in lieu of fixed pins, for example.

Once the guide pins are engaged, the assembly as herein described enables the crane to be redeployed, thereby significantly reducing crane time utilizes during installation. Thus, once the upper pole segment is stacked and the alignment pin(s) are engaged, the crane can be released to go to the assembly. The final engagement of the slip fit can be achieved later with the flange bolts and this feature saves valuable crane time.

The extraction bolts 113, 115, 113.1, 115.1, 113.2, and 115.2 as herein described facilitate selective removal of the utility pole segments should this be required. This disassembly provision may thus be said to provide an easy method for disassembly if required.

The slip fit connections as herein described have been tapered, with the end portion of a first of the utility pole segments being tapered to fit with the end portion of a second of the utility pole segments. Alternatively, the end portions may be configured without a taper, such that a straight-fit connection is provided.

It will be appreciated that many variations are possible within the scope of the invention described herein. For example, the flanges as herein described are welded to the utility pole segments. However, this is not strictly required and the flanges may couple to the utility pole segments in other manners in other embodiments for example, or may be integrally connected to and formed with the pole segment in other examples.

It will also be understood by someone skilled in the art that many of the details provided above are by way of example only and are not intended to limit the scope of the invention which is to be determined with reference to at least the following claims.

What is claimed is:

1. A utility pole assembly comprising:

a utility pole including a plurality of pole segments, a first said pole segment having an outer diameter, the first said pole segment including a flange having an inner diameter generally equal to the outer diameter of the first said pole segment, and the first said pole segment including a tapered end portion, the tapered end portion extending through the flange and the flange being welded to the first said pole segment thereafter, and a second said pole segment having an outer diameter, the second said pole segment including a flange having an inner diameter generally equal to the outer diameter of the second said pole segment, and the second said pole segment having a distal end, the flange of the second said pole segment extending about and being welded to said distal end of the second said pole segment, each said flange having at least one alignment aperture extending therethrough; and at least one longitudinally-extending alignment member, the at least one longitudinally-extending alignment member having a threaded portion and including an elongate shaft coupled to and extending outwards from said threaded portion, the threaded portion of the at least one longitudinally-extending alignment member being shaped to threadably engage the alignment aperture of a first one of the flanges and the elongate shaft of the at least one longitudinally-extending alignment member being extendable through the alignment aperture of a second one of the flanges, whereby the second said pole segment is shaped to extend about the end portion of the first said pole segment, align relative to the first said pole segment via the at least one longitudinally-extending alignment member so as to lock orientation of the second said pole segment relative to the first said pole segment, and thereafter slip fit to the end portion of the first utility pole segment such that the second utility pole segment fully receives the end portion of the first utility pole segment and the flanges abut each other.

2. The assembly as claimed in claim 1 wherein the assembly has a longitudinal axis, the flanges extending radially outwards from the axis, the alignment member extending longitudinally and parallel with said axis, and the flange of the first said pole segment being longitudinally spaced-apart from a distal end of the first said pole segment.

3. The assembly as claimed in claim 1 wherein the first one of the flanges has a plurality of fastener apertures and wherein the second one of the flanges has a plurality of fastener apertures positioned to align with respective ones of the fastener apertures of the first one of the flanges upon the alignment member connecting with the first one of the flanges and extending through the second one of the flanges, and wherein the at least one longitudinally-extending alignment member is a guide pin having a head and a tapered end spaced-apart from the head, the elongate shaft of the guide pin extending between the threaded portion of the guide pin and the tapered end of the guide pin, the threaded portion of the guide pin being adjacent to said head, and the head of the guide pin abutting said first one of the flanges upon the threaded portion of the guide pin threadably engaging the alignment aperture of said first one of the flanges.

4. The assembly as claimed in claim 3 further including a plurality of fasteners shaped to extend through said fastener apertures so aligned to selectively couple together the flanges.

5. The assembly as claimed in claim 1 further including a plurality of nuts and bolts shaped to threadably engage with respective said nuts, the flanges being connectable together via said nuts and said bolts after slip fitting of the second said pole segment to the first said pole segment.

6. The assembly as claimed in claim 1 wherein each of the flanges includes a plurality of circumferentially spaced-apart, radially outwardly extending protrusions, the protrusions of the first one of the flanges aligning within the protrusions of the second one of the flanges upon the alignment member extending through the second one of the flanges.

7. The assembly as claimed in claim 6 wherein each of the protrusions has a substantially planar top and bottom, and is generally rectangular in shape.

8. The assembly as claimed in claim 1, wherein the second one of the flanges has a further plurality of circumferentially spaced-apart alignment apertures extending therethrough, wherein the assembly includes a further plurality of longitudinally-extending alignment members threadably engageable with respective said alignment apertures of the first one of the flanges, the alignment members being circumferentially spaced-apart and being shaped to extend through respective ones of the alignment apertures of the second one of the flanges, and wherein each of the flanges has a plurality of circumferentially spaced-apart fastener apertures extending therethrough, the fastener apertures of the first one of the flanges aligning with the fastener apertures of the second one of the flanges upon the alignment members extending through the alignment apertures.

9. The assembly as claimed in claim 8 wherein each of the alignment members is between paired ones of the fastener apertures of the first one of the flanges and wherein each of the alignment apertures is between paired ones of the fastener apertures of the second one of the flanges.

10. The assembly as claimed in claim 1, wherein the assembly has a longitudinal axis, wherein each of the flanges includes a plurality of circumferentially spaced-apart, radially outwardly-extending protrusions, each of the protrusions having at least one fastener aperture extending therethrough, each of the protrusions of the first one of the flanges further having an alignment aperture extending therethrough, wherein the assembly includes two additional alignment members, each of the alignment members of the assembly being threadably engagement with and extending axially outwards from respective ones of the protrusions of the first one of the flanges, the alignment members being shaped to extend into respective ones of the alignment apertures of the second one of the flanges upon the second said pole segment extending about the end portion of the first said pole segment, and wherein the fastener apertures of the first one of the flanges are positioned to align with the fastener apertures of the second one of the flanges upon the alignment members being so received by the alignment apertures.

11. The assembly as claimed in claim 10 further including a plurality of fasteners shaped to extend axially through the fastener apertures so aligned to further couple together the flanges after slip fitting of the second said pole segment to the first said pole segment.

12. The assembly as claimed in claim 1, wherein the end portion of the first said pole segment tapers radially-inwards as the end portion extends from the flange of the first said pole segment to a distal end of the first said pole segment.

13. The assembly as claimed in claim 12, wherein the assembly has an annular gap, the gap extending radially between the end portion of the first said pole segment at a location adjacent to the flange of the first said pole segment and the second said pole segment at a location adjacent to the flange of the second said pole segment, said gap enabling the second said pole segment to slide upon the first side pole segment and said gap enabling the flanges to abut with each other.

14. The assembly as claimed in claim 1, wherein the pole segments couple together via a tapered slip-fit connection having a tapered portion, and wherein the alignment member is shaped to lock orientation of the first said pole segment relative to the second said pole segment prior to the tapered portion of the slip-fit connection being engaged.

15. The assembly as claimed in claim 1, further including an annular small clearance gap extending between an inner annular surface of the second said pole segment and an outer annular surface of the end portion of the first said pole segment, said gap enabling the second said pole segment to slide upon the first side pole segment and said the gap enabling the flanges to abut with each other.

16. A method of connecting together a first utility pole segment to a second utility pole segment, the method comprising:

extending a tapered end portion of the first utility pole segment through a first flange and thereafter coupling the first flange to a side of the first utility pole segment;

positioning a second flange adjacent to a distal end of the second utility pole segment and thereafter coupling the second flange to a side of the second utility pole segment;

coupling at least one longitudinally-extending alignment member to one of the flanges;

positioning the second utility pole segment about the end portion of the first utility pole segment;

aligning the second utility pole segment relative to the first utility pole segment via the at least one longitudinally-extending alignment member so as to lock orientation of the first pole segment relative to the second pole segment;

slip fit connecting the second utility pole segment to the end portion of the first utility pole segment such that the second utility pole segment fully receives the end portion of the first utility pole segment and the flanges abut each other, the at least one longitudinally-extending alignment member being sufficiently long to lock said orientation of the second said pole segment relative to the first said pole segment before the taper of the slip-fit connection engages; and coupling the flanges of the utility pole segments so aligned slip fit together via one or more fasteners.

17. The method as claimed in claim 16 further comprising:

providing a first of the flanges with said alignment member and at least one fastener aperture;

providing a second of the flanges with at least one alignment aperture shaped to receive the alignment member; and providing the second of the flanges with at least one fastener aperture which aligns with the at least one fastener aperture of the first of the flanges upon the alignment member extending through the at least one alignment aperture.

18. The method as claimed in claim 17, further comprising within the providing the first of the flanges with said alignment member step:

coupling the alignment member to the first of the flanges.

19. A utility pole assembly comprising:

a utility pole including a plurality of pole segments, a first said pole segment having a tapered end portion and including a flange through which the end portion extends, the flange coupling to, extending perpendicular to, and extending outwards from a side of the first said pole segment, and a second said pole segment including a flange adjacent to a distal end thereof, the flange of the second said pole segment coupling to, extending perpendicular to, and extending outwards from a side of the second said pole segment; and at least one longitudinally-extending alignment member, the at least one longitudinally-extending alignment member having a threaded portion and including an elongate shaft coupled to and extending outwards from said threaded portion, the threaded portion of the at least one longitudinally-extending alignment member being shaped to threadably engage the alignment aperture of a first one of the flanges and the elongate shaft of the at least one longitudinally-extending alignment member being extendable through the alignment aperture of a second one of the flanges, whereby the second said pole segment is shaped to extend about the end portion of the first said pole segment, align relative to the first said pole segment via the at least one longitudinally-extending alignment member so as to lock orientation of the second said pole segment relative to the first said pole segment, and thereafter slip fit to the end portion of the first utility pole segment such that the second utility pole segment fully receives the end portion of the first utility pole segment and the flanges abut each other.

20. A utility pole assembly comprising:

a pair of pole segments, each including a flange having at least one fastener aperture and at least one alignment aperture; and an alignment member having a threaded portion and including an elongate shaft coupled to and extending outwards from said threaded portion, the threaded portion of the alignment member being shaped to threadably engage the alignment aperture of a first one of the flanges and the elongate shaft of the alignment member being extendable through the alignment aperture of a second one of the flanges so as to align the fastener apertures of the flanges, the pole segments so aligned being shaped to couple together thereafter in part via a slip fit connection, with the flanges being positioned to abut each other upon the pole segments connecting together via said slip fit connection; and at least one said fastener extendable through said fastener apertures of the flanges so abutting to further couple together the pole segments.

* * * * *

UNITED STATES PATENT AND TRADEMARK OFFICE

CERTIFICATE OF CORRECTION

PATENT NO. : 10,294,687 B2
APPLICATION NO. : 15/346673
DATED : May 21, 2019
INVENTOR(S) : Ted Brockman, Zoltan Banyi and Ioan Giosan It is certified that error appears in the above-identified patent and that said Letters Patent is hereby corrected as shown below:

In the Claims

Column 9, Line 34 to Column 10, Line 5 should read:
1. A utility pole assembly comprising:
a utility pole including a plurality of pole segments, a first said pole segment having an outer diameter, the first said pole segment including a flange having an inner diameter generally equal to the outer diameter of the first said pole segment, and the first said pole segment including a tapered end portion, the tapered end portion extending through the flange and the flange being welded to the first said pole segment thereafter, and a second said pole segment having an outer diameter, the second said pole segment including a flange having an inner diameter generally equal to the outer diameter of the second said pole segment, and the second said pole segment having a distal end, the flange of the second said pole segment extending about and being welded to said distal end of the second said pole segment, each said flange having at least one alignment aperture extending therethrough; and
at least one longitudinally-extending alignment member, the at least one longitudinally-extending alignment member having a threaded portion and including an elongate shaft coupled to and extending outwards from said threaded portion, the threaded portion of the at least one longitudinally-extending alignment member being shaped to threadably engage the alignment aperture of a first one of the flanges and the elongate shaft of the at least one longitudinally-extending alignment member being extendable through the alignment aperture of a second one of the flanges, whereby the second said pole segment is shaped to extend about the end portion of the first said pole segment, align relative to the first said pole segment via the at least one longitudinally-extending alignment member so as to lock orientation of the second said pole segment relative to the first said pole segment, and thereafter slip fit to the end portion of the first said pole segment such that the second said pole segment fully receives the end portion of the first said pole segment and the flanges abut each other.

Column 12, Lines 32 to 63 should read:
19. A utility pole assembly comprising:

Signed and Sealed this
Twenty-third Day of July, 2019

Andrei Iancu

Andrei Iancu
*Director of the United States Patent and Trademark Office* a utility pole including a plurality of pole segments, a first said pole segment having a tapered end portion and including a flange through which the end portion extends, the flange coupling to, extending perpendicular to, and extending outwards from a side of the first said pole segment, and a second said pole segment including a flange adjacent to a distal end thereof, the flange of the second said pole segment coupling to, extending perpendicular to, and extending outwards from a side of the second said pole segment; and at least one longitudinally-extending alignment member, the at least one longitudinally-extending alignment member having a threaded portion and including an elongate shaft coupled to and extending outwards from said threaded portion, the threaded portion of the at least one longitudinally-extending alignment member being shaped to threadably engage an alignment aperture of a first one of the flanges and the elongate shaft of the at least one longitudinally-extending alignment member being extendable through an alignment aperture of a second one of the flanges, whereby the second said pole segment is shaped to extend about the end portion of the first said pole segment, align relative to the first said pole segment via the at least one longitudinally-extending alignment member so as to lock orientation of the second said pole segment relative to the first said pole segment, and thereafter slip fit to the end portion of the first said pole segment such that the second said pole segment fully receives the end portion of the first said pole segment and the flanges abut each other.